US007710377B2

(12) United States Patent
Kang et al.

(10) Patent No.: US 7,710,377 B2
(45) Date of Patent: May 4, 2010

(54) LCD PANEL INCLUDING GATE DRIVERS

(75) Inventors: Won-sik Kang, Seoul (KR); Seong-cheol Kim, Seoul (KR); Sung-jin Jang, Seoul (KR); Jae-hyuck Woo, Gyeonggi-do (KR); Chul Choi, Seoul (KR); Kyu-young Chung, Seoul (KR)

(73) Assignee: Samsung Electronics Co., Ltd. (KR)

( * ) Notice: Subject to any disclaimer, the term of this patent is extended or adjusted under 35 U.S.C. 154(b) by 1343 days.

(21) Appl. No.: 11/170,943

(22) Filed: Jun. 30, 2005

(65) Prior Publication Data

US 2006/0007094 A1 Jan. 12, 2006

(30) Foreign Application Priority Data

Jul. 1, 2004 (KR) ..... 10-2004-0051145

(51) Int. Cl.
*G09G 3/36* (2006.01)

(52) U.S. Cl. ..... 345/96; 345/98; 345/209

(58) Field of Classification Search ..... 345/87, 345/96, 98, 209; 348/550, 793
See application file for complete search history.

(56) References Cited

U.S. PATENT DOCUMENTS 5,434,899 A 7/1995 Huq et al.
5,475,397 A 12/1995 Saidi
5,606,342 A 2/1997 Shoji et al.
5,859,630 A 1/1999 Huq
6,229,515 B1 5/2001 Itoh et al.
6,441,858 B1 8/2002 Nakamoto et al.
6,442,206 B1 8/2002 Hrusecky (Continued)

FOREIGN PATENT DOCUMENTS

JP 2000-250496 A 9/2000

(Continued)

OTHER PUBLICATIONS

Notice to Submit Response, KR 10-2004-0051145, Dec. 7, 2005.

(Continued)

*Primary Examiner*—Amr Awad
*Assistant Examiner*—Michael Pervan
(74) *Attorney, Agent, or Firm*—Myers Bigel Sibley & Sajovec, P.A.

(57) ABSTRACT

Provided is a liquid crystal display panel having gate drivers. The LCD panel includes a gate line shift circuit setting a gate line scanning order such that the gate lines are sequentially scanned in units of n gate lines with k−1 gate lines between each pair of adjacent gate lines in each unit according to an interleaving method in response to a gate line-on signal received from a timing control unit outside the LCD panel, wherein the LCD panel reproduces source data output from a source driver outside the LCD panel in the gate line scanning order set by the gate line shift circuit. The LCD panel inverts the polarity of a common voltage for every unit of n gate lines, instead of every gate line, thereby reducing power consumption. In addition, since every $k^{th}$ gate line is scanned according to the interleaving method, deterioration of image quality such as a flickering phenomenon can be prevented, which is an advantage of a line inversion driving method.

10 Claims, 12 Drawing Sheets

U.S. PATENT DOCUMENTS

| | | | |
|---|---|---|---|
| 6,449,025 | B2 | 9/2002 | Lee |
| 6,462,798 | B1 | 10/2002 | Kim et al. |
| 6,490,332 | B1 | 12/2002 | Somayajula |
| 6,639,641 | B1 | 10/2003 | Ko et al. |
| 6,665,035 | B2 | 12/2003 | Lee |
| 6,670,935 | B2 | 12/2003 | Yeon et al. |
| 6,680,769 | B1 | 1/2004 | Lee et al. |
| 6,750,935 | B2 | 6/2004 | Seo et al. |
| 6,791,647 | B1 | 9/2004 | Kim et al. |
| 6,809,787 | B1 | 10/2004 | Seo et al. |
| 7,050,038 | B2 | 5/2006 | Matsuda et al. |
| 7,176,875 | B2 | 2/2007 | Nagata et al. |
| 2001/0040545 | A1 | 11/2001 | Mishima et al. |
| 2002/0012091 | A1 | 1/2002 | Lee |
| 2002/0030656 | A1 | 3/2002 | Goto et al. |
| 2002/0044119 | A1 | 4/2002 | Kwon |
| 2002/0118184 | A1 | 8/2002 | Yeon et al. |
| 2002/0145693 | A1 | 10/2002 | Kim et al. |
| 2002/0176034 | A1 | 11/2002 | Lee |
| 2003/0006948 | A1 | 1/2003 | Son et al. |
| 2003/0038766 | A1 | 2/2003 | Lee et al. |
| 2003/0048248 | A1 | 3/2003 | Fukumoto et al. |
| 2003/0086043 | A1 | 5/2003 | Seo et al. |
| 2003/0160752 | A1 | 8/2003 | Park |
| 2004/0001036 | A1 | 1/2004 | Takayama et al. |
| 2004/0095307 | A1 | 5/2004 | Kim |
| 2004/0109117 | A1 | 6/2004 | Lee et al. |
| 2004/0246422 | A1 | 12/2004 | Seo et al. |
| 2005/0146490 | A1 | 7/2005 | Kang et al. |

FOREIGN PATENT DOCUMENTS

| | | | |
|---|---|---|---|
| JP | 2004-4857 | A | 1/2004 |
| KR | 10-2005-0071957 | A | 7/2005 |
| WO | WO 03/030137 | A2 | 4/2003 |
| WO | WO 2006/018800 | A1 | 2/2006 |

OTHER PUBLICATIONS

Rapport Betreffende Het Onderzoek Naar de Stand Van de Techniek, NO Application No. 1029392, Mar. 17, 2006.

LCD PANEL INCLUDING GATE DRIVERS

This application claims the priority of Korean Patent Application No. 10-2004-0051145, filed on Jul. 1, 2004, in the Korean Intellectual Property Office, the disclosure of which is incorporated herein in its entirety by reference.

BACKGROUND OF THE INVENTION

1. Field of the Invention

The present invention relates to a liquid crystal display (LCD), and more particularly, to a driving unit and a timing controller which control an LCD to drive gate lines included in the LCD in units of a predetermined number of gate lines, and a driving method used by the LCD.

2. Description of the Related Art

A conventional liquid crystal display (LCD) applies an adjustable voltage to a material having an anisotropic permittivity injected between two substrates to adjust the amount of light transmitted through the substrates, thereby obtaining a desired image. The LCD includes a plurality of scan lines transmitting gate select signals and a plurality of data lines crossing the scan lines and transmitting color data, i.e., image data. The LCD also includes a plurality of pixels arranged in a matrix pattern, disposed at intersections of the scan lines and the data lines, and connected to one another by the scan lines, the data lines, and switching devices.

To transmit image data to each of the pixels of the LCD, on/off signals are sequentially transmitted to gate lines (scan lines). Then, the switching devices connected to the gate lines are sequentially turned on/off. Simultaneously, an image signal to be transmitted to a row of pixels corresponding to a gate line is converted into a gradation voltage that can take on a plurality of voltage levels, and the gradation voltage is applied to each data line. Here, during one frame cycle, gate signals are sequentially transmitted to all the scan lines such that pixel signals are transmitted to all rows of pixels. As a result, an image of one frame is displayed.

When an electric field is continuously applied to the LCD in one direction, characteristics of the LCD deteriorate due to inherent characteristics of a liquid crystal material. Therefore, the polarity of a common voltage must be inverted. In other words, if a positive voltage is applied to a pixel in a frame, a negative voltage should be applied to the same pixel in another frame. Consequently, the positive and negative voltages are repeatedly applied to the same pixel in an alternating fashion.

A method of inversion-driving an LCD includes a frame inversion driving method in which the polarity of a common voltage is inverted in units of frames, a line inversion driving method in which the polarity of the common voltage is inverted in units of gate lines whenever each gate line is scanned, and a dot inversion driving method in which the polarity of the common voltage is inverted in units of pixels.

Intermediate gradation screens, such as a screen displayed when Windows is closed, of LCDs using the dot inversion driving method experience shake. In addition, since data lines are driven at large amplitude in the dot inversion driving method, high power consumption is required. Thus, LCDs using the dot inversion driving method are seldom used for portable terminals.

FIG. 1A illustrates gate lines driven using the frame inversion driving method. Referring to FIG. 1A, the polarity of a common voltage Vcom is inverted in units of frames. A positive common voltage is applied to an $N^{th}$ frame to sequentially scan all the gate lines for the $N^{th}$ frame, and image data of the $N^{th}$ frame is output. Then, a negative common voltage is applied to an $N+1^{th}$ frame to sequentially scan all the gate lines for the $N+1^{th}$ frame. If 60 frames are scanned per second, an LCD inverts the polarity of the common voltage Vcom every 1/60 of a second.

The LCD consumes power whenever the polarity of the common voltage Vcom is inverted. Thus, a frame inversion driving method in which the polarity of the common voltage Vcom is inverted less frequently has lower power consumption. However, since the polarity of all the gate lines is inverted each frame, all the gate lines have the same polarity. Therefore, a difference in liquid crystal transmittance of two frames is easily recognized, causing the screen to flicker. Thus, the frame inversion driving method is rarely used.

FIG. 1B illustrates gate lines driven using the line inversion driving method. Referring to FIG. 1B, the polarity of a common voltage Vcom is inverted whenever each of the gate lines for an $N^{th}$ frame is scanned. For example, if positive-polarity data is transmitted to odd numbered scan lines, negative-polarity data is transmitted to even numbered scan lines. When an $N+1^{th}$ frame is scanned, the polarity of the even numbered scan lines and that of the odd numbered scan lines are inverted, thereby preventing deterioration of the liquid crystal material. In addition, since the polarity of the common voltage Vcom is inverted in units of lines, the problem of screen flickering can be solved.

However, since the polarity of the common voltage Vcom is inverted for each gate line, high power consumption is required. Such high power consumption puts an LCD using the line inversion driving method at a great disadvantage when the LCD is to be used in portable devices constrained by power. For example, if the LCD has 480 gate lines, the LCD inverts the polarity of the common voltage Vcom once every 1/(60×480) of a second, consuming much power.

FIG. 1C illustrates gate lines driven using an n-line inversion driving method. Referring to FIG. 1C, after n gate lines are scanned, the polarity of a common voltage Vcom is inverted. Then, another n gate lines are scanned. After a frame is scanned in this way, the polarity of the common voltage Vcom applied to the next frame is opposite to that applied to the previous frame.

Since the gate lines are scanned in units of n lines using the common voltage Vcom of the same polarity and then the polarity of the common voltage Vcom is inverted, the n-line inversion driving method can reduce power consumption to 1/n that used in the line inversion driving method. In other words, if the polarity of the common voltage Vcom is inverted every three lines, the polarity of the common voltage is inverted once every 3/(60×480) of a second. However, since the polarity of the common voltage Vcom is inverted every n adjacent lines, the n-line inversion driving method results in flickering.

FIG. 2 is a graph illustrating power consumption of each of the inversion driving methods. Referring to FIG. 2, while 1.35 mA are consumed in the frame inversion driving method, 1.85 mA are consumed in the line inversion driving method. It can be seen that a 2-line inversion driving method consumes 1.60 mA, which is between 1.35 mA of the frame inversion driving method and 1.85 mA of the line inversion driving method. On the other hand, a 3-line inversion driving method consumes 1.47 mA. Therefore, it can be understood that far less power is consumed in a 2- or greater line inversion driving method than in the line inversion driving method. However, when the 2 or more line inversion driving method is used, a number of adjacent lines have the same polarity, and thus the problem of flickering emerges.

SUMMARY OF THE INVENTION

The present invention provides an apparatus that drives gate lines in such a way that power consumption is reduced and flickering of an image displayed is prevented, and a liquid crystal display (LCD).

According to an aspect of the present invention, there is provided an LCD panel having gate drivers. The LCD panel includes: a plurality of pixels formed at intersections of a plurality of gate lines and a plurality of data lines, respectively; and a gate line shift circuit setting a gate line scanning order such that the gate lines are sequentially scanned in units of n gate lines with k−1 gate lines between each pair of adjacent gate lines in each unit according to an interleaving method, in response to a gate line-on signal received from a timing control unit outside the LCD panel, wherein the LCD panel reproduces source data output from a source driver outside the LCD panel in the gate line scanning order set by the gate line shift circuit.

The LCD panel may invert the polarity of a gate electrode each time the LCD panel finishes scanning one unit of n gate lines.

The n gate lines may be three gate lines and the intervals of the k gate lines are intervals of two gate lines, the gate line shift circuit may repeat sequentially scanning three 2k-th (k denotes a constant) gate lines after sequentially scanning three (2k+1)-th gate lines, and the LCD panel may invert the polarity of the gate electrode whenever three gate lines are scanned.

The gate line shift circuit includes a plurality of gate line switch blocks and each of the gate line switch blocks includes six switches operating in synchronization with a clock signal and an inverted clock signal. Each of the six switches is connected to a corresponding gate line, and a first switch in a first switch block is controlled by the gate line-on signal input from a timing control unit and a first switch in a next switch block is controlled by an output signal of a last switch in a previous switch block.

Each of the switch blocks may include: a first switch corresponding to a first gate line; a second switch corresponding to a second gate line; a third switch corresponding to a third gate line; a fourth switch corresponding to a fourth gate line; a fifth switch corresponding to a fifth gate line; and a sixth switch corresponding to a sixth gate line, wherein the first switch is turned on in response to the clock signal and the gate line-on signal or the output signal of the sixth switch in the previous block and turned off in response to an output signal of the third switch, the second switch is turned on in response to the inverted clock signal and an output signal of the fifth switch and turned off in response to an output signal of the fourth switch, the third switch is turned on in response to the inverted clock signal and an output signal of the first switch and turned off in response to the output signal of the fifth switch, the fourth switch is turned on in response to the clock signal and an output signal of the second switch and turned off in response to an output signal of the sixth switch, the fifth switch is turned on in response to the clock signal and the output signal of the third switch and turned off in response to the output signal of the second switch, and the sixth switch is turned on in response to the inverted clock signal and the output signal of the fourth switch and turned off in response to an output signal of the first switch in the next switch block.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

Figure 1A:
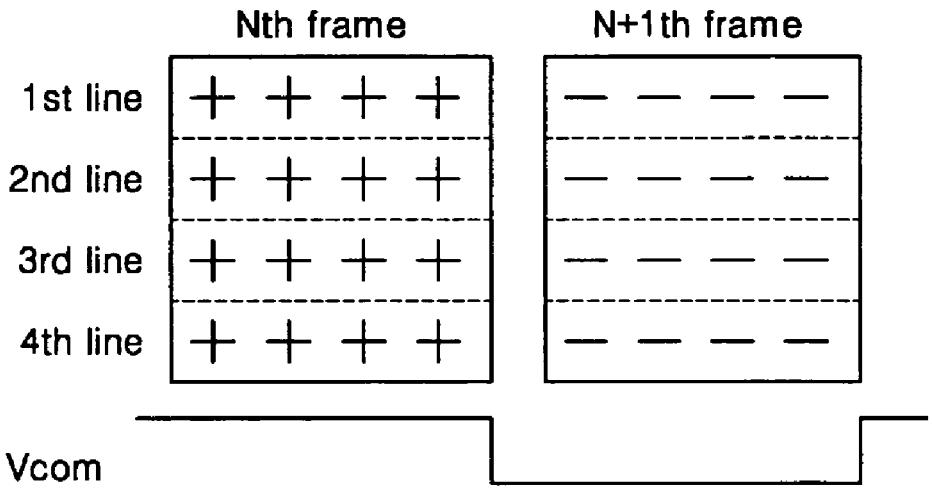
FIG. 1A (PRIOR ART)
FIGS. 1A through 1C illustrate various conventional inversion driving methods of driving gate lines.
Figure 1B:
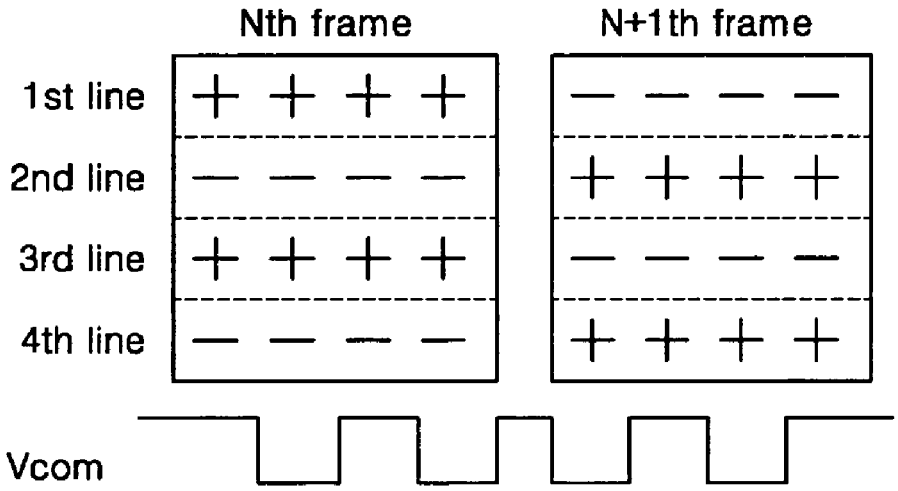
FIG. 1B (PRIOR ART)
Figure 1C:
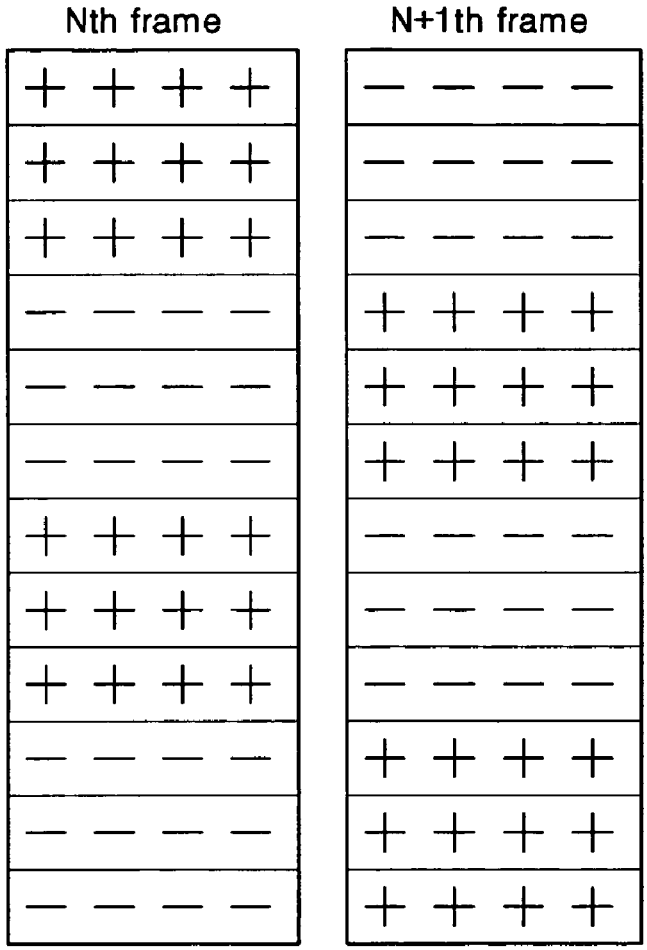
FIG. 1C (PRIOR ART)
Figure 1C:
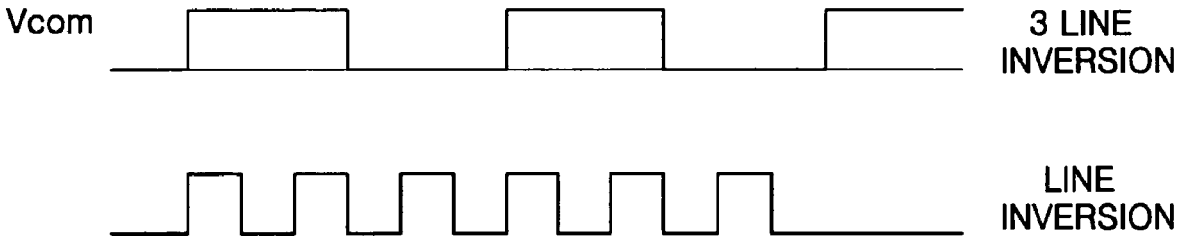
FIG. 1C (PRIOR ART)

The present invention will now be described more fully with reference to the accompanying drawings, in which exemplary embodiments of the invention are shown. The invention may, however, be embodied in many different forms and should not be construed as being limited to the embodiments set forth therein; rather, these embodiments are provided so that this disclosure will be thorough and complete, and will fully convey the concept of the invention to those skilled in the art. Like reference numerals in the drawings denote like elements, and thus their description will omitted.

Figure 3:
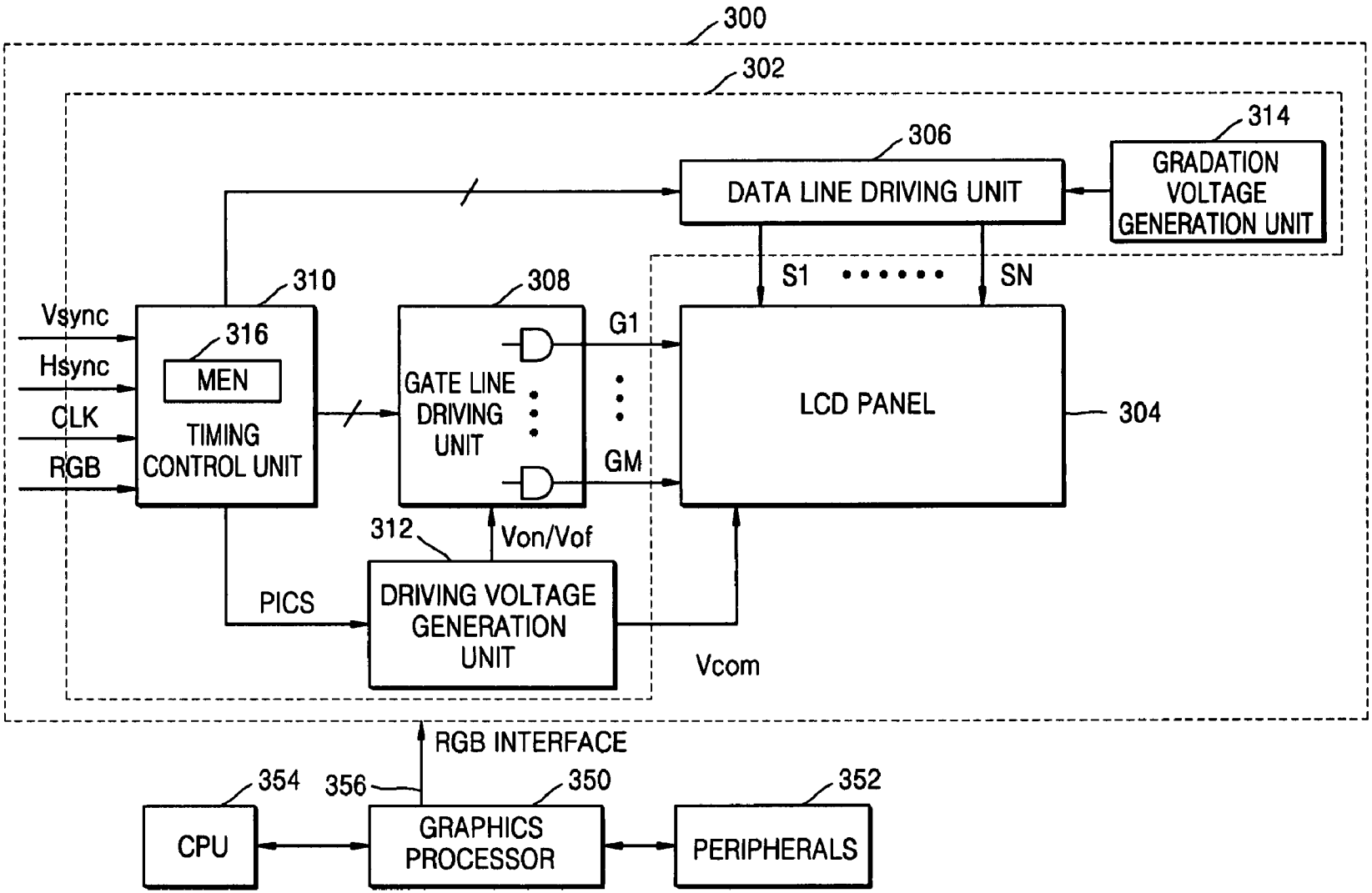
FIG. 3 is a block diagram of a liquid crystal display (LCD) and its surrounding circuitry according to an embodiment of the present invention.

FIG. 3 is a block diagram of a liquid crystal display (LCD) 300 and its surrounding circuitry according to an embodiment of the present invention. Referring to FIG. 3, the LCD 300 receives image data from a graphics processor 350 via a red, green, and blue (RGB) interface 356. The graphics processor 350 receives data from a central processing unit (CPU) 354 and peripherals 352 such as a camera and generates image data corresponding to the resolution of the LCD 300.

The LCD 300 includes a driving unit 302 and an LCD panel 304. The driving unit 302 includes a data line driving unit 306, a gate line driving unit 308, a timing control unit 310, a driving voltage generation unit 312, and a gradation voltage generation unit 314.

The LCD panel 304 comprises two substrates (for example, a thin film transistor (TFT) substrate or a color filter substrate). A plurality of source lines and a plurality of gate lines are formed on a substrate to cross one another. Pixels are respectively formed at the intersections of the gate lines and the source lines.

The timing control unit 310 receives an RGB data signal, a vertical synchronous signal Vsync, which is a frame discrimination signal, a horizontal synchronous signal Hsync, which is a row discrimination signal, and a main clock signal CLK from the graphics processor 350 and outputs digital signals for driving the gate line driving unit 308, the data line driving unit 306, and the driving voltage generation unit 312, respectively.

The timing control unit 310 outputs a gate clock signal for applying a gate-on voltage to each of the gate lines and a gate-on enable signal for enabling an output of the gate line driving unit 308 to the gate line driving unit 308. The timing control unit 310 changes an existing sequential scanning order to a new scanning order in which the gate lines are sequentially scanned in units of a predetermined number (hereinafter referred to as "n") of lines at intervals of another predetermined number of lines (hereinafter referred to as "k lines") such that the gate line driving unit 308 can scan the gate lines in the new scanning order and transmits the gate clock signal to the gate line driving unit 308.

In other words, the timing control unit 310 divides gate line addresses into n×k gate line addresses. Then, instead of sequentially transmitting image data of adjacent gate lines to the gate line driving unit 308, the timing control unit 310 rearranges the gate lines in units of n gate lines at intervals of k gate lines and outputs the image data of the rearranged gate lines to the gate line driving unit 308. That is, the gate signals are divided into blocks of n×k gate lines, and the gate clock signal enables every kth gate line in each of the blocks. In detail, instead of sequentially transmitting image data of sequential gate lines to the gate line driving unit 308, the timing control unit 310 rearranges the gate lines in units of n gate lines with k−1 gate lines between adjacent gate lines in each unit, and outputs the image data according to the order of the rearranged gate lines to the gate line driving unit 308. For example, if there are 480 gate lines in a frame, n=5 and k=3, the gate lines are scanned in the order of 1, 4, 7, 10, 13, 2, 5, 8, 11, 14, 3, 6, 9, 12, 15, . . . , 477, and 480. The timing control unit 310 outputs the image data to the gate line driving unit 308 in this gate line scanning order.

The driving voltage generation unit 312 receives from the timing control unit 310 a polarity inversion control signal PICS for inverting the polarity of a common voltage Vcom whenever the gate lines are scanned in units of n lines and generating the common voltage Vcom. In other words, the driving voltage generation unit 312 applies a positive voltage to each of n gate lines scanned, inverts the polarity of the common voltage Vcom, and then applies a negative voltage to each of another n gate lines scanned, in response to the polarity inversion control signal PICS output from the timing control unit 310.

The timing control unit 310 receives image data signals, rearranges the image data signals according to the rearrangement of data lines for the data line signals, and outputs the image data signals to the data line driving unit 306 according to the rearranged order of the data lines. The timing control unit 310 rearranges the addresses of image data stored in a memory 316 included in the timing control unit 310 according to the rearranged order of the data lines. Therefore, if there are 480 data lines, n=5 and k=3, the image data sequentially for the $1^{st}$, $4^{th}$, $7^{th}$, $10^{th}$, $13^{th}$, $2^{nd}$, $5^{th}$, $8^{th}$, $11^{th}$, $14^{th}$, $3^{rd}$, $6^{th}$, $9^{th}$, $12^{th}$, $15^{th}$, . . . , $480^{th}$ scan lines is output to the data line driving unit 306 according to the new gate line scanning order.

The data line driving unit 306, also called a source driver, includes a plurality of data line drivers, converts image data transmitted to each pixel in the LCD panel 304 to a predetermined voltage and outputs the predetermined voltage in units of lines. More specifically, the data line driving unit 306 stores image data output from the timing control unit 310 in a latch unit included in the data line driving unit 306. In response to a command signal for reproducing the image data on the LCD panel 304, the data line driving unit 306 selects a voltage corresponding to each digital data and transmits the voltage corresponding to the image data to the LCD panel 304.

Since the data line driving unit 306 transmits the image data to the LCD panel 306 according to the order in which the image data is output from the timing control unit 310, the image data is output in units of the n lines at intervals of the k lines according to the rearrangement of data lines.

The gate line driving unit 308, also called a scan line driver, includes a plurality of gate drivers and controls gates of the pixels such that the image data received from the data line driving unit 306 can be transmitted to the pixels, respectively. Each of the pixels of the LCD panel 304 is turned on or off by a transistor functioning as a switch. The transistor turns each pixel on or off by applying a gate-on voltage Von or a gate-off voltage Voff to the gate of each pixel.

The gate line driving unit 308 receives a gate-on-enable signal output from the timing control unit 310 and sequentially applies the gate-on voltage Von to each gate line according to an input gate line order. Therefore, the gate lines are turned on in units of n gate lines at intervals of the k lines, that is, with k−1 gate lines between the adjacent gate lines in each unit.

The gradation voltage generation unit 314 generates a gradation voltage depending on the a number of bits of the RGB data signal output from the graphics processor 350 and transmits the gradation voltage to the data line driving unit 306.

The driving voltage generation unit 312 generates the gate-on voltage Von for turning the gate of each pixel on and the gate-off voltage Voff for turning the gate of each pixel off and provides the gate-on voltage Von and the gate-off voltage Voff to the gate line driving unit 308. In addition, the driving voltage generation unit 312 generates the common voltage Vcom, which is a reference voltage for a data voltage applied to transistors of pixels, and provides the common voltage Vcom to a common electrode of each pixel.

The driving voltage generation unit 312 inverts the polarity of the common voltage Vcom in response to the polarity inversion control signal PICS output from the timing control unit 310.

In the LCD 300, the polarity of the common voltage Vcom is inverted in units of the n lines. Therefore, the LCD 300 consumes far less power than LCDs using the line conversion driving method. Furthermore, since every $k^{th}$ gate line is sequentially scanned, flickering caused by luminance differences can be reduced to a degree of flickering in the line inversion driving method.

Figure 4:
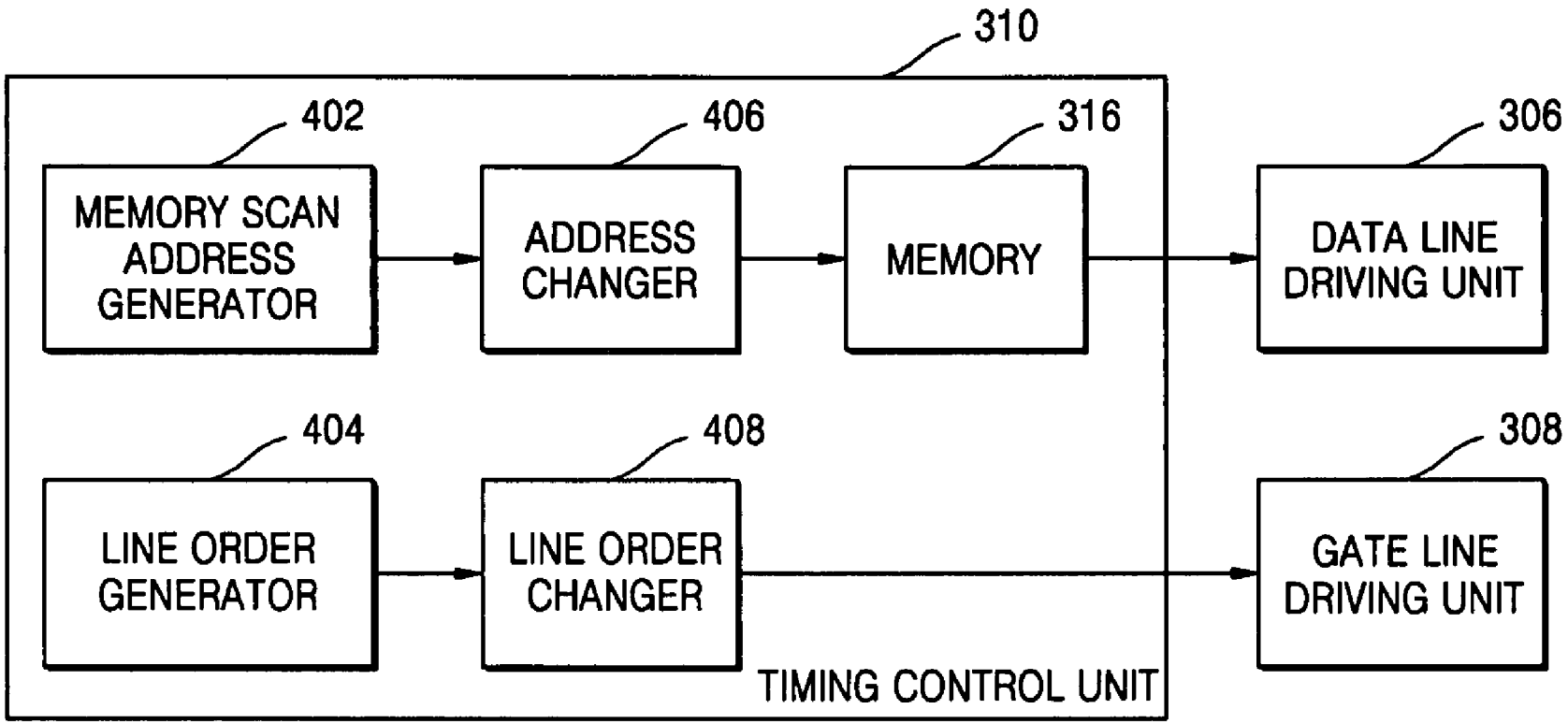
FIG. 4 is a detailed block diagram of a timing control unit of FIG. 3.

FIG. 4 is a detailed block diagram of the timing control unit 310 of FIG. 3. Referring to FIG. 4, the timing control unit 310 includes a memory scan address generator 402 generating addresses in an order in which image data input from the graphics processor 350 is output, a line order generator 404 determining an order in which gates of the gate drivers are turned on, an address change circuit 406 rearranging the order in which the image data is output, a line order changer 408 rearranging the order in which the gate drivers are turned on, and the memory 316 storing the changed addresses.

The memory scan address generator 402 generates addresses for storing the image data received from the graphics processor 350 in the memory 316. The address changer 406 rearranges the addresses in units of n gate lines at intervals of k lines (that is, in units of n gate lines with k−1 gate lines between each pair of adjacent gate lines in each unit), and the rearranged addresses are stored in the memory 316 of the timing controller 310. Accordingly, the image data is stored in the memory 316 according to a changed data output order. Similarly, the data line driving unit 306 sequentially outputs the image data according to the changed data output order.

The line order changer 408 rearranges the order in which the gate lines are turned on generated by the line order generator 404 in units of n gate lines at intervals of k lines (that is, in units of n gate lines with k−1 gate lines between each pair of adjacent gate lines in each unit) and outputs the image data to the gate line driving unit 308 in the rearranged order. The address changer 406 and the line order changer 408 may or may not be included in the timing control unit 310.

Figure 5:
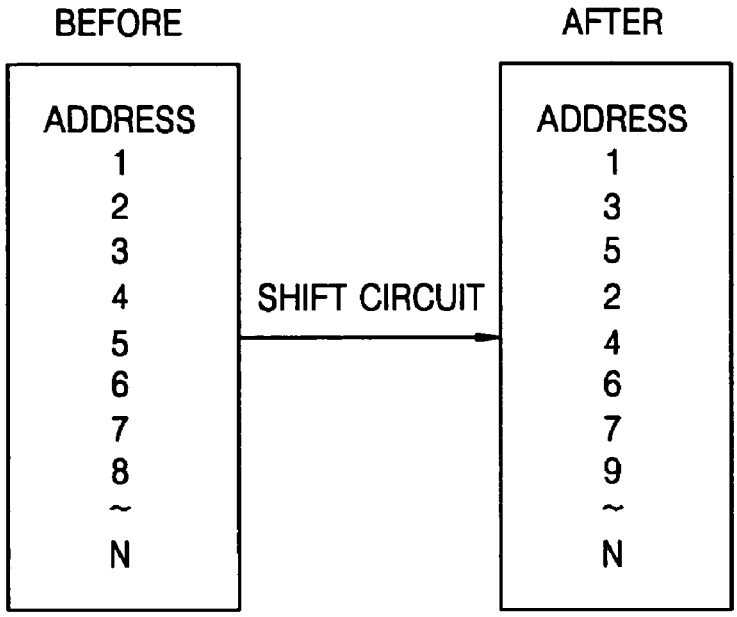
FIG. 5 illustrates a rearrangement of addresses by an address changer.

FIG. 5 illustrates a rearrangement of addresses by the address changer 406. The address changer 406 receives addresses output from the memory scan address generator 402, rearranges the addresses according to an interlace method of the present invention, and outputs the rearranged addresses.

In a conventional method of outputting image data, memory scan addresses are sequentially generated since the address changer 406 is not present. Accordingly, the image data is sequentially stored.

Referring to FIG. 5, the addresses are rearranged in units of three lines at intervals of two lines (that is, with 1 line interposed between each pair of adjacent lines in each unit). The memory scan address generator 402 of FIG. 4 sequentially generates 1 through N addresses. Then, the addresses are rearranged by the address changer 406 in units of n lines at intervals of the k lines (in units of 3 lines with 1 line between each pair of adjacent lines in each unit) and stored in the memory 316 of the timing control unit 310. Accordingly, image data is stored in an order of the rearranged addresses, i.e., the changed data output order.

Figure 6:
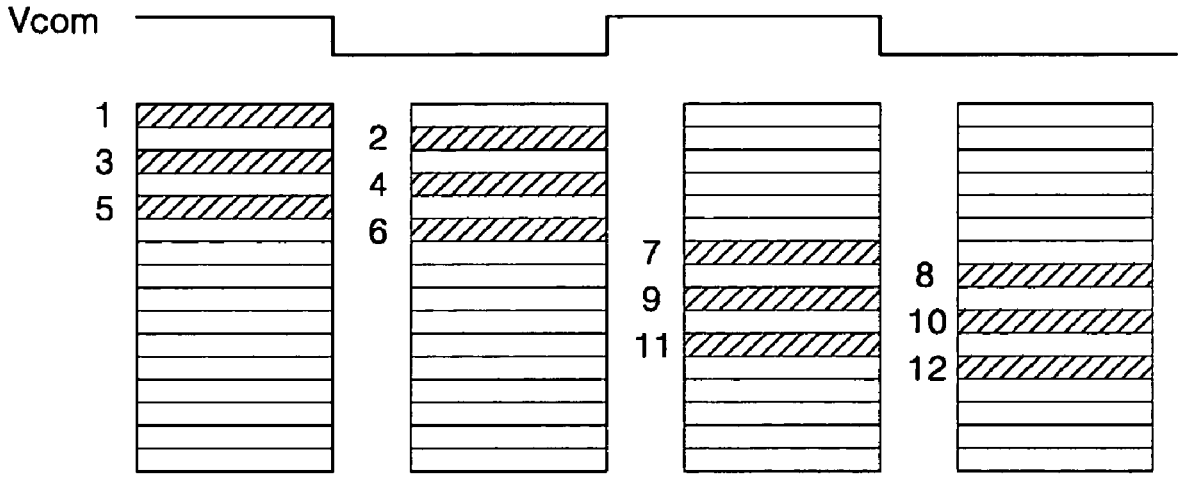
FIG. 6 illustrates gate lines driven using an N-line inversion driving method in an order of rearranged addresses of FIG. 5.

FIG. 6 illustrates the gate lines driven using an N-line inversion driving method in the order of the rearranged addresses of FIG. 5. First, image data for a first line 1 is output from the data line driving unit 306 and, at the same time, a gate of the first line is turned on. Since the gate lines are scanned at intervals of two lines, the image data for a third line 3 is output from the data line driving unit 306, and a gate of the third line 3 is turned on by the gate line driving unit 308. Next, image data for a fifth line 5 is output from the data line driving unit 306, and a gate of the fifth line 5 is turned on by the gate line driving unit 308. After the three gate lines are scanned in this way, the polarity of the common voltage Vcom applied to a common electrode of the pixels is inverted by the polarity inversion control signal PICS.

Then, image data for a second line 2 is output from the data line driving unit 306, and at the same time, a gate of the second line 2 is turned on. Image data for a fourth line 4 is output from the data line driving unit 306, and a gate of the fourth line 4 is turned on by the gate line driving unit 308. Image data for a sixth line 6 is output from the data line driving unit 306, and a gate of the sixth line 6 is turned on by the gate line driving unit 308. Then, the polarity of the common voltage Vcom is inverted in response to the polarity inversion control signal PICS.

Again, after image data in seventh, ninth, and eleventh lines 7, 9, and 11 are sequentially displayed, the polarity of the common voltage Vcom is inverted. Then, image data in eighth, tenth, and twelfth lines 8, 10, and 12 are sequentially displayed. This process of inverting the polarity of the common voltage Vcom is repeated.

Figure 2:
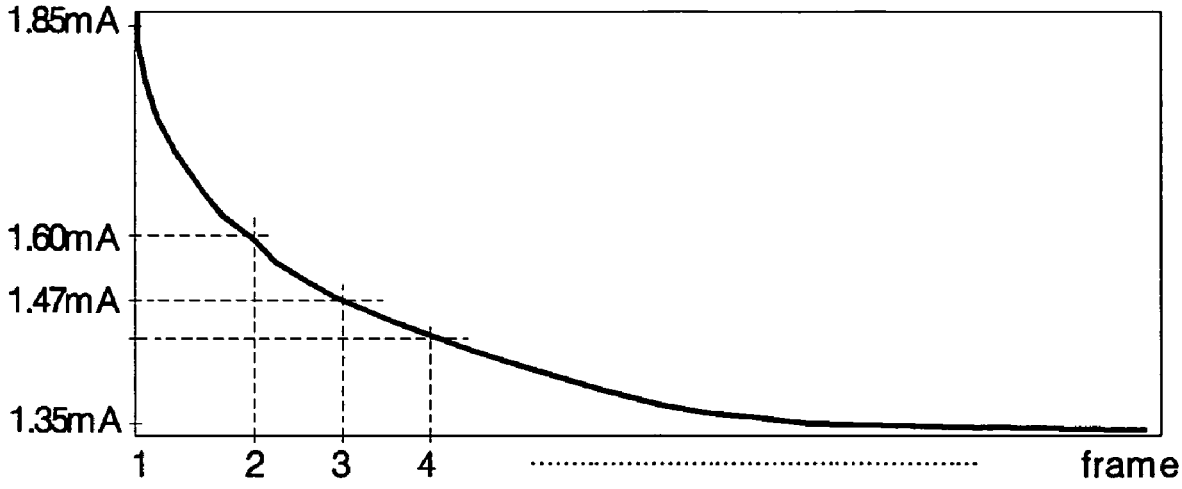
FIG. 2 (PRIOR ART)
FIG. 2 is a graph illustrating power consumption of each of the inversion driving methods illustrated in FIG. 1.

In the N-line inversion driving method described above, the polarity of the common voltage Vcom is inverted whenever N lines of image data is scanned. Thus, far less power is consumed in the N-line inversion driving method than in the line inversion driving method (see FIG. 2). For example, if the polarity of the common voltage Vcom is inverted every three lines, as illustrated in FIG. 6, 1.47 mA of current is consumed.

In addition, in the N-line inversion driving method, since the gate lines are scanned at intervals of k, the problem of screen flickering that occurs when adjacent lines are sequentially scanned can be prevented. In other words, the polarity of the common voltage Vcom is inverted every N lines, instead of every line, thereby reducing power consumption. In addition, since the gate lines are scanned at intervals of the k lines according to the interlace method, the deterioration of image quality due to flickering can be prevented, which is an advantage of the line inversion driving method.

The LCD 300 may be used when image data is received directly from the CPU 354 or from a graphics source via the RGB interface 356.

Figure 7:
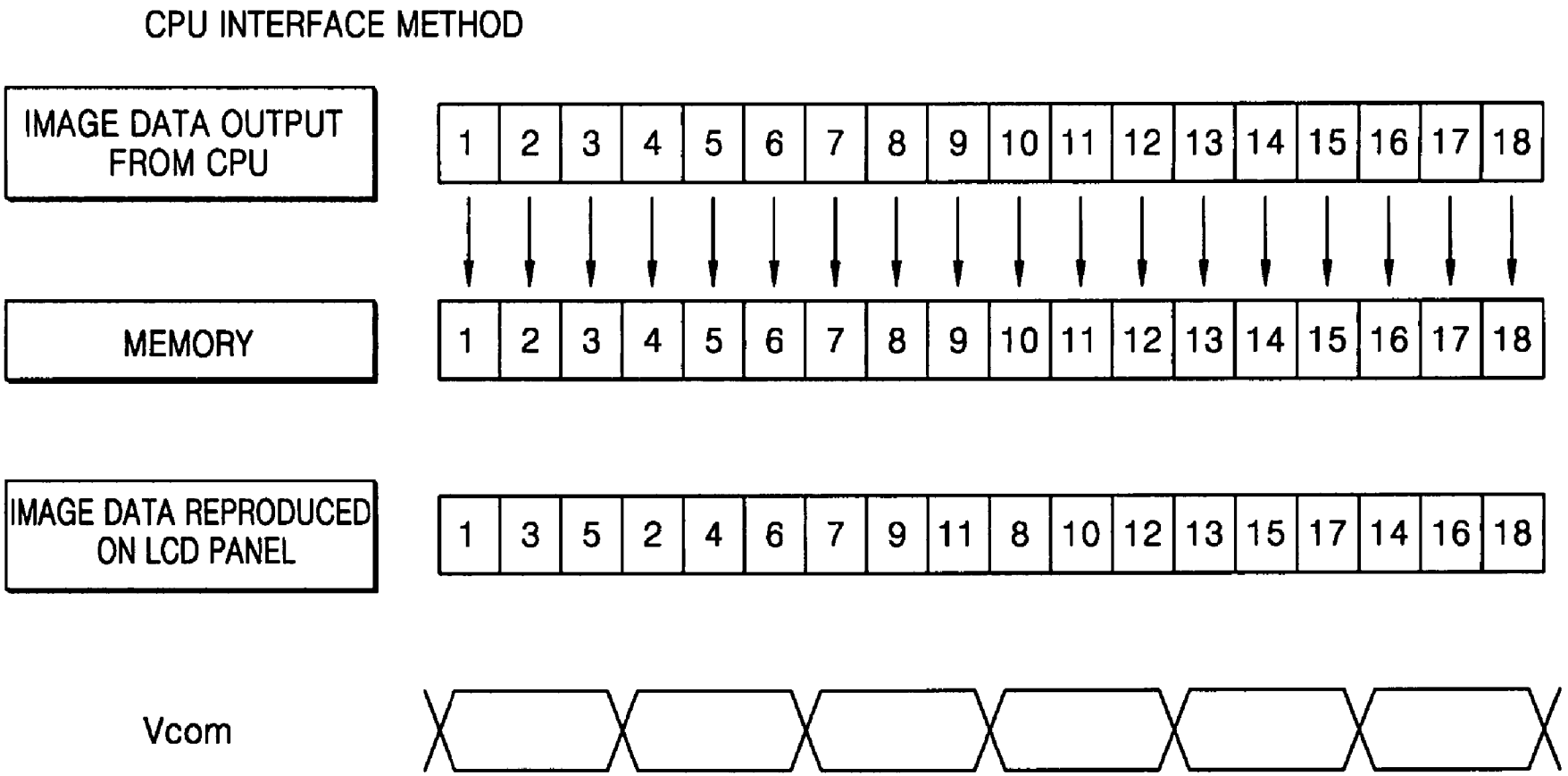
FIG. 7 illustrates an order in which image data is stored according to an embodiment of the present invention.

FIG. 7 illustrates an order in which image data is stored according to an embodiment of the present invention. Specifically, FIG. 7 illustrates an order in which the image data output from the CPU 354 in units of frames is stored.

Referring to FIGS. 3 and 7, the image data created by the CPU 354 is stored in a memory of the CPU 354 in units of frames. The image data sequentially output from the CPU 354 is stored again in the memory 316 of the LCD 300 in order of 1, 3, 5, 2, 4, 6, 7, 9, 11, 8, 10, 12 . . . , according to the order of memory addresses rearranged in units of three lines at intervals of two lines (in units of three lines with 1 line between each pair of adjacent lines in each unit). Then, the image data is transmitted to the data line driving unit 306 and then output to the LCD panel 304 in the order in which the image data is stored. Here, the polarity of the common voltage Vcom is inverted every three lines.

The image data may be sequentially stored in the memory 316 of the LCD 300 in the order in which the image data is output from the CPU 354 without an address change. The addresses may be changed thereafter, and the image data may be output to the LCD panel 304 in the changed order of addresses.

Figure 8:
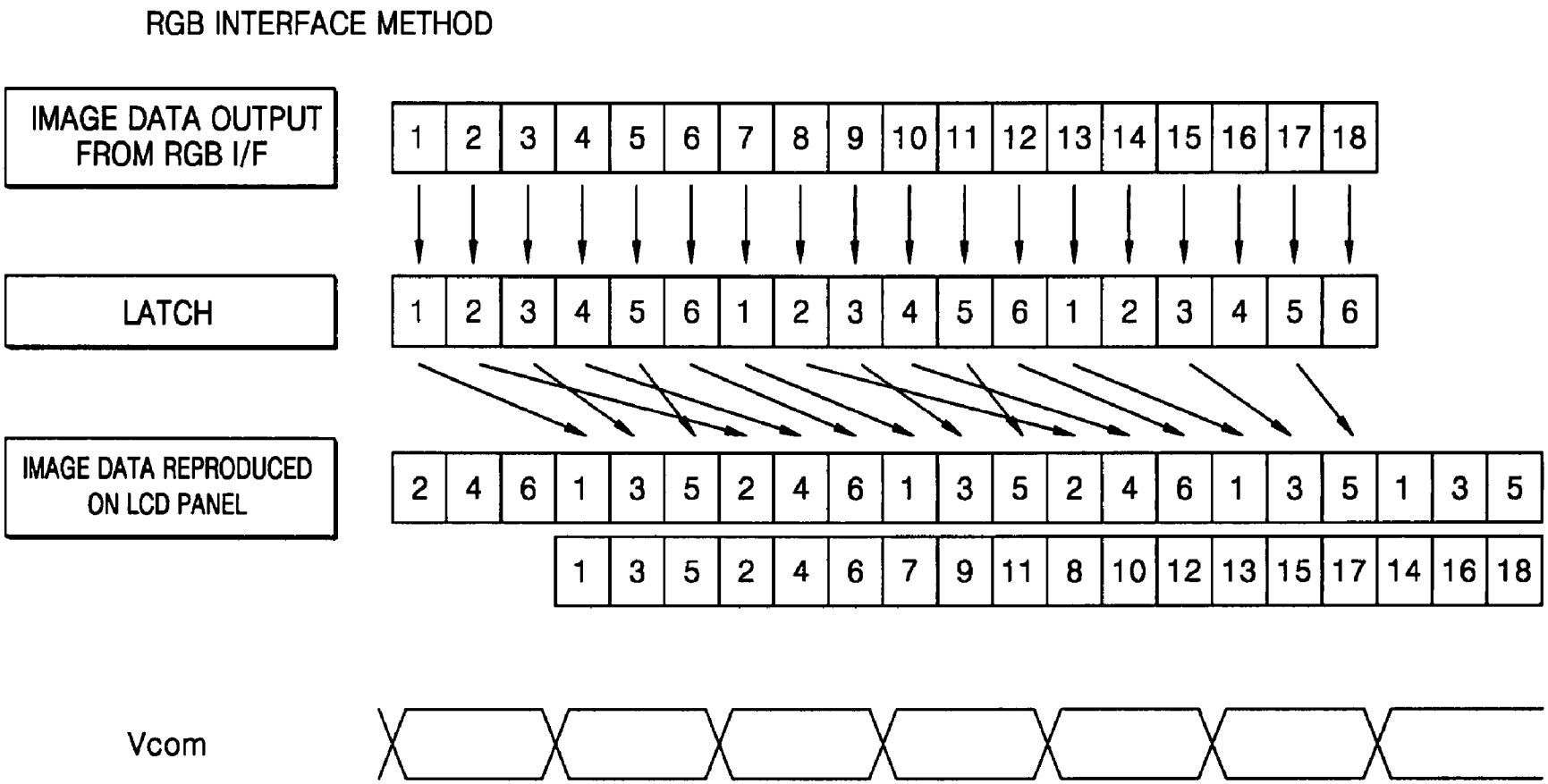
FIG. 8 illustrates an order in which image data is stored according to another embodiment of the present invention.

FIG. 8 illustrates an order in which image data is stored according to another embodiment of the present invention. Referring to FIGS. 3 and 8, not all data in a frame is stored. FIG. 8 illustrates the order in which image data output in units of lines from the graphics source via the RGB interface 356 is stored. The data output from the graphics source is stored in the memory 316, which, in the present embodiment, can store a block of image data for units of three lines at intervals of two lines (with 1 line between each pair of adjacent lines in each unit), that is, six lines of image data.

In other words, when image data for first through sixth lines is output from the graphics source, the image data for the first through sixth lines is sequentially stored at first through sixth line addresses of the memory 316. Then, the image data for the first through sixth lines is output to the LCD panel 304 according to the addresses rearranged in units of three lines at interval of two lines (with 1 line between each pair of adjacent lines in each unit). When all of the images data for the six lines is output, image data for seventh through twelfth lines is output from the graphics source and stored in the first through sixth line addresses of the memory 316. Again, the addresses are rearranged in the order 1, 3, 5, 2, 4, and 6, and the image data for the seventh through twelfth lines is output to the LCD panel 304 according to the rearranged addresses. In other words, the image data is output from the graphics source in the order 7, 9, 11, 8, 10, and 12.

When data sequentially output from the graphics processor 350 is stored in a latch (memory) of the LCD 300, the data can be stored in a different order corresponding to the rearranged addresses. In this case, the data is output to the LCD panel 304 in the order in which the data is stored in the latch.

In an RGB interface output method, not all image data in a frame can be rearranged at once. Since six lines of image data are received and output in a rearranged order, there is a delay of about three lines. For example, image data for a fifth line is output fifth from the graphics source. However, the image data is actually output third from a data line driver. Therefore, the rearranged data is output after a delay of three lines. Here, the polarity of the common voltage Vcom is inverted every three lines.

When this method is used, not all image data in a frame is stored. Instead, only six lines of image data is latched in a small memory that can store only six lines of image data, thereby reducing the required memory size.

Some conventional LCD panels, such as LTPS or ASG, may not be able to control gate drivers. Such LCD panels are controlled by a source driver without using gate drivers. Unlike LCD panels including gate drivers, in LCD panels without the gate drivers, since a gate line scanning order sequentially proceeds in a predetermined direction, the gate lines cannot be scanned at intervals. Thus, the method described above cannot be used.

In this regard, an LCD panel including gate drivers must include a gate line shift circuit changing a sequential gate line scanning order into an interlaced gate line scanning order. In other words, the LCD panel 304 including the gate drivers according to an embodiment of the present invention is designed such that the gate line shift circuit scans the gate lines at predetermined intervals, whereas conventional LCD panels including gate drivers are designed such that the gate line shift circuit sequentially scans the gate lines.

Figure 9:
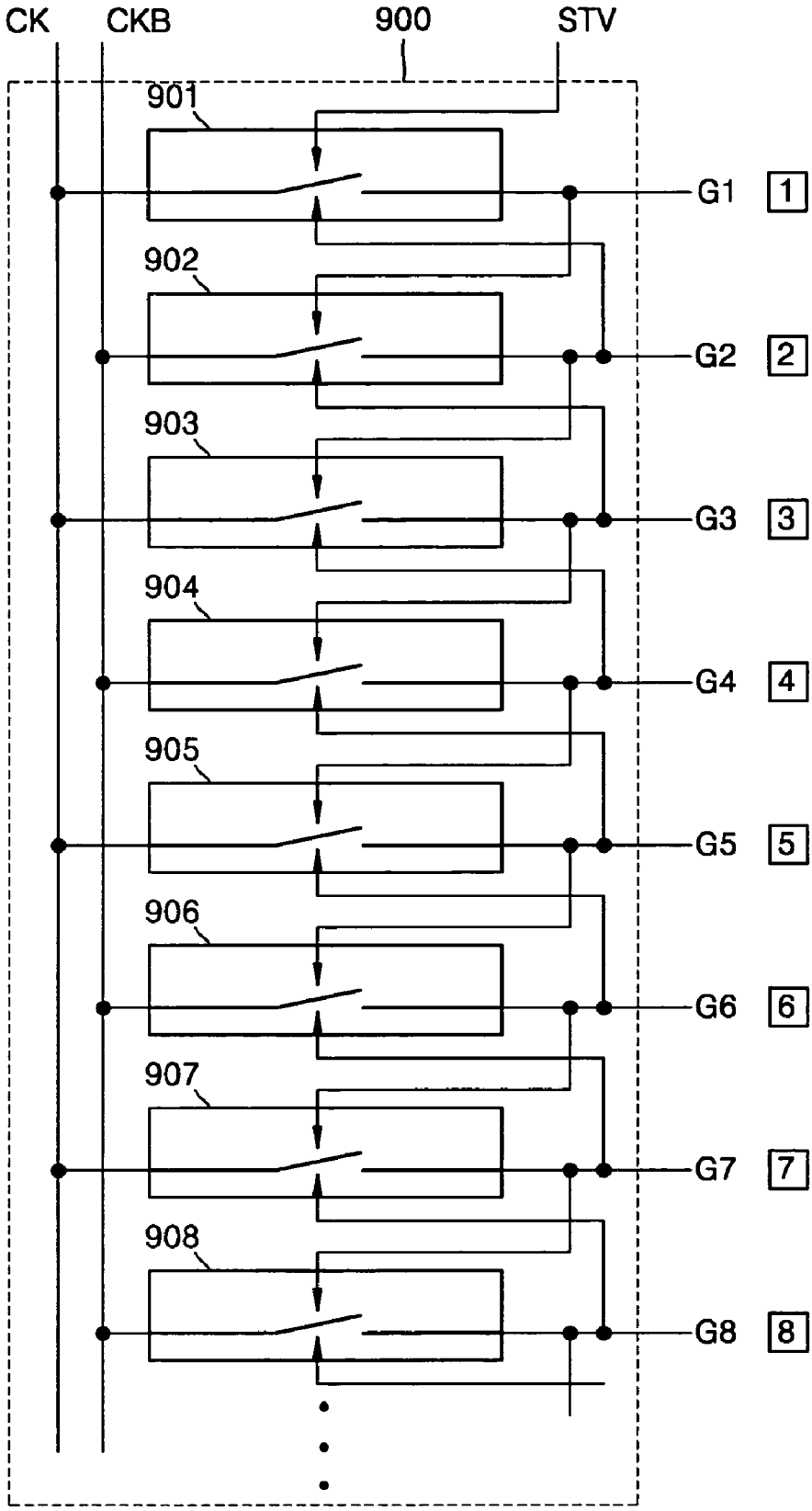
FIG. 9 (PRIOR ART)
FIG. 9 is a circuit diagram of a gate line shift circuit included in a conventional LCD panel including gate drivers.

FIG. 9 is a circuit diagram of a gate line shift circuit 900 included in a conventional LCD panel having gate drivers. Referring to FIG. 9, the gate line shift circuit 900 includes first through eighth switches 901 through 908 and a pair of lines connected to a clock signal CK and an inverted clock signal CKB for synchronizing the scanning of the gate line shift circuit 900.

The clock signal CK is input to the first switch 901, the third switch 903, the fifth switch 905, and the seventh switch 907, and the inverted clock signal CKB is input to the second switch 902, the fourth switch 904, the sixth switch 906, and the eighth switch 908. In other words, the clock signal CK and the inverted clock signal CKB are connected to the first through eighth switches 901 through 908 in an alternating fashion. In addition, a gate line-on signal STV for starting the scanning of each gate line when each frame is displayed on the LCD panel is output from a timing control circuit and input to the first switch 901.

A gate signal output from a current switch is output to a previous switch and turns off the previous switch, and is output to a next switch and turns on the next switch.

Figure 10:
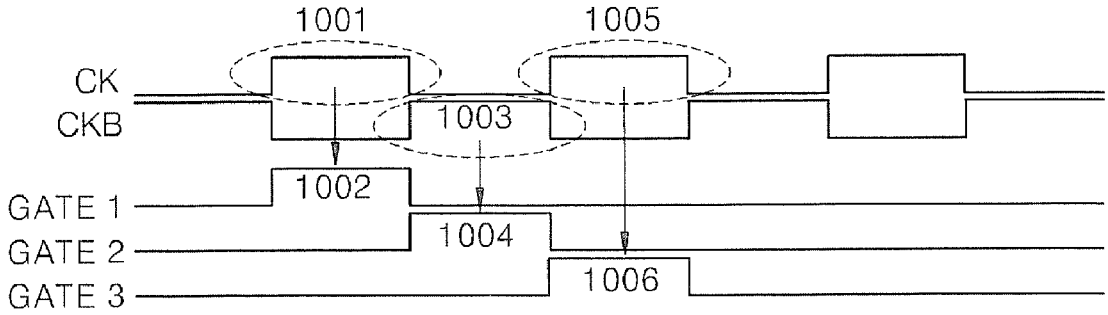
FIG. 10 (PRIOR ART)
FIG. 10 is a timing diagram of each switch included in the gate line shift circuit in the circuit diagram of FIG. 9.

FIG. 10 is a timing diagram for the switches included in the gate line shift circuit 900 of FIG. 9. Referring to FIG. 10, the clock signal CK and the inverted clock signal CKB have inverted phases, and the gate lines are sequentially turned on whenever the phases of the clock signal CK and the inverted clock signal CKB switch.

The operation of the conventional LCD including the gate drivers will now be described with reference to FIGS. 9 and 10. When the clock signal CK is high (1001), the first switch 901 is turned on and thus the first gate line control signal GATE1 switches to a high level (1002), and data for a first gate line G1 is displayed. Then, when the inverted clock signal CKB switches to a high level (1003), the first gate line control signal GATE1 turns on the second switch 902 and thus the second gate line control signal GATE2 switches to a high level (1004). As a result, the first switch 901 is turned off, and data for the second gate line G2 is displayed.

When the clock signal CK switches to a high level again (1005), the second gate line control signal GATE2 turns on the third switch 903, and thus the third gate line control signal GATE3 switches to a high level (1006). As a result, the second switch 902 is turned off, and data in the third gate line G3 is displayed.

When the LCD including the gate drivers of FIG. 9 is used, gate lines are sequentially turned on. Therefore, the interleaving scanning method according to the present invention cannot be used.

Figure 11:
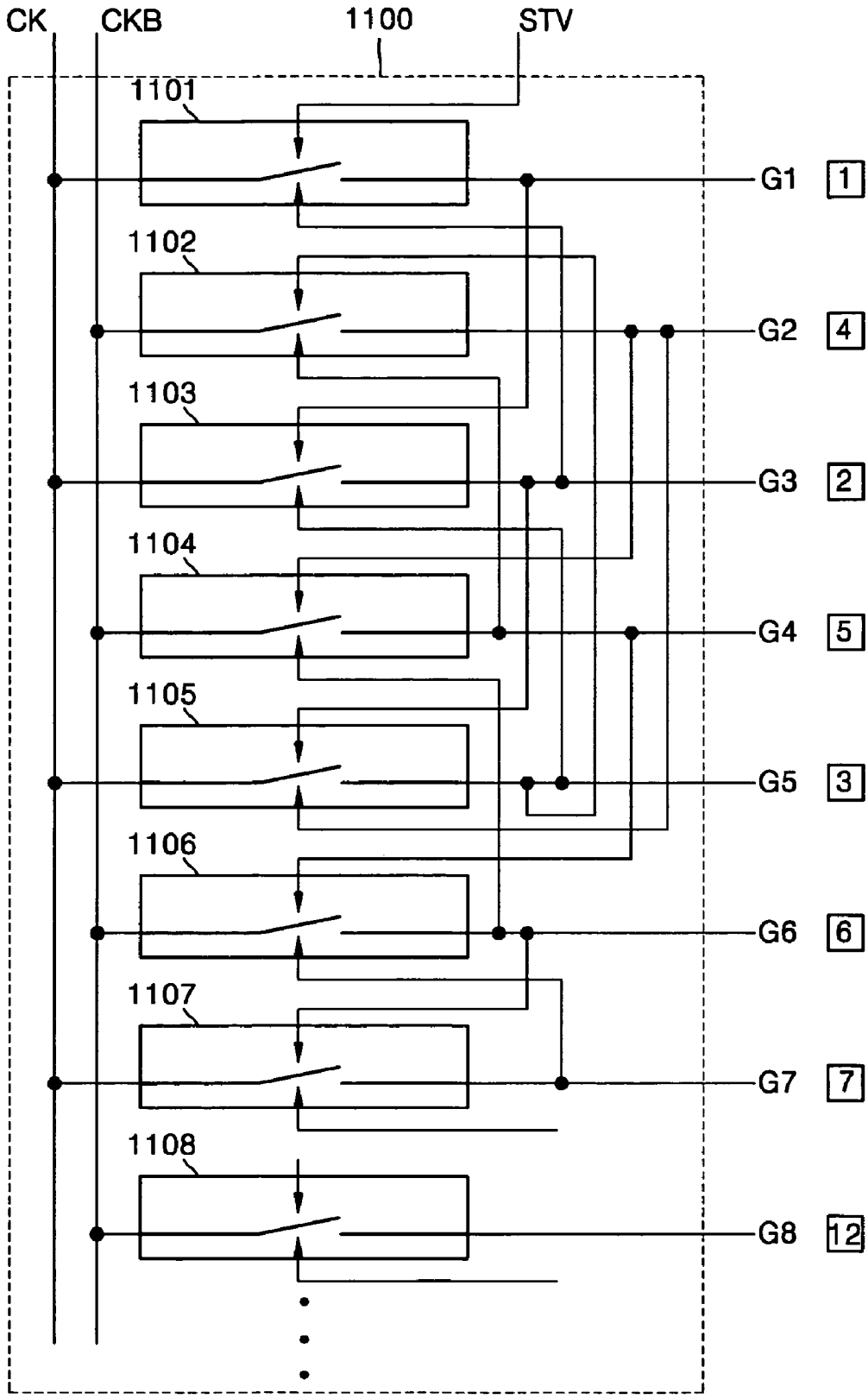
FIG. 11 is a circuit diagram of a gate line shift circuit included in an LCD including gate drivers according to an embodiment of the present invention.

FIG. 11 is a circuit diagram of a gate line shift circuit 1100 included in an LCD having gate drivers according to an embodiment of the present invention. Referring to FIG. 11, the gate line shift circuit 1100 includes first through eighth switches 1101 through 1108 and a pair of lines supplying the clock signal CK and the inverted clock signal CKB for synchronizing the scanning of the gate line shift circuit 1100.

The clock signal CK and the inverted clock signal CKB are connected to the first through twelfth switches 1101 through 1108 in an alternating fashion. In the present embodiment illustrated in FIG. 11, image data is scanned in units of three lines at intervals of two lines (with one line between each pair of adjacent lines in each unit). Therefore, the first switch 1101 receives the clock signal CK, the third switch 103 receives the inverted clock signal CKB, the fifth switch 1105 receives the clock signal CK, the second switch 1102 receives the inverted clock signal CKB, the fourth switch 1104 receives the clock signal CK, and the sixth switch receives the inverted clock signal CKB. The seventh through twelfth switches receive the clock signal CK and the inverted clock signal CKB in a similar manner.

In addition, the gate line-on signal STV for starting the scanning gate lines when each frame is displayed on the LCD panel is output from a timing control circuit and input to the first switch 1101. A gate signal output from a current switch is output to a previous switch turned on by the clock signal CK and turns off the previous switch, and is output to a next switch to be turned on by the clock signal CK and turns on the next switch.

Figure 12:
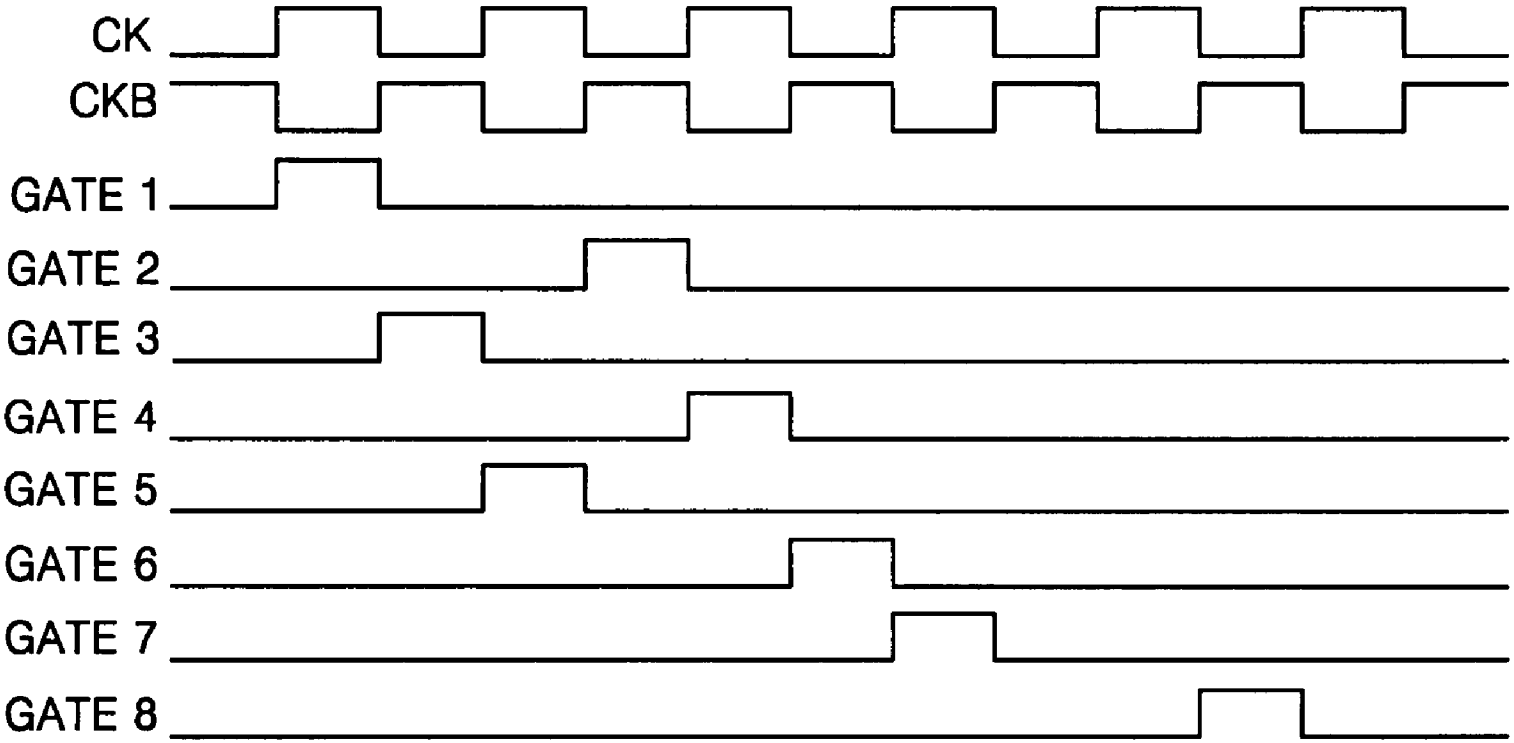
FIG. 12 is a timing diagram of each signal illustrated in FIG. 11.

FIG. 12 is a timing diagram of each signal illustrated in FIG. 11. In FIG. 12, the clock signal CK and the inverted clock signal CKB have inverted phases, as in FIG. 10. Whenever the clock signal CK switches, gate lines are sequentially turned on. In addition, the first through eighth gate line control signals GATE1 through GATE8 output from the first through eighth switches 1101 through 1108 are transmitted to the gate lines in the LCD panel. Therefore, when the first through eighth gate signals GATE1 through GATE8 are respectively high, corresponding gate lines are turned on and source data for the gate lines is displayed.

The operation of the LCD panel including the gate drivers according to an embodiment of the present invention will now be described with reference to FIGS. 11 and 12. When the clock signal CK is high, the first switch 1101 is turned on. Accordingly, the first gate line control signal GATE1 becomes high, and data for the first gate line G1 is displayed. When the inverted clock signal CKB switches to a high level, the third switch 1103, which receives the first gate line control signal GATE1, is turned on, and the first switch 1101 is turned off. Accordingly, the third gate line control signal GATE3 becomes high, and data in the third gate line G3 is displayed.

Then, when the clock signal CK switches to a high level again, the fifth switch 1105 connected to the third gate line control signal GATE3 is turned on, and the third switch 1103 is turned off. Accordingly, the fifth gate line control signal GATE5 becomes high, and data for the fifth gate line G5 is displayed.

When the inverted clock signal CKB switches to a high level, the second switch 1102, which receives the fifth gate line control signal GATE5, is turned on, and the fifth switch 1105 is turned off. Accordingly, the second gate line control signal GATE2 becomes high, and data for the second gate line G2 is displayed. Then, when the clock signal CK switches to a high level, the fourth switch 1104, which receives the second gate line control signal GATE2, is turned on, and the second switch 1102 is turned off. Accordingly, the fourth gate line control signal GATE4 becomes high, and data for the fourth gate line G4 is displayed. When the inverted clock signal CKB switches to a high level, the sixth switch 1106, which receives the fourth gate line control signal GATE4, is turned on, and the fourth switch 1104 is turned off. Accordingly, the sixth gate line control signal GATE6 becomes high, and data for the sixth gate line G6 is displayed.

Then, when the clock signal CK switches to a high level, the seventh through twelfth gate lines are turned on in the manner descried above.

A scanning order of gate lines by the gate line shift circuit 1100 is indicated by boxed numbers next to the gate lines on the right side of FIG. 11.

Meanwhile, the polarity of the common voltage Vcom is inverted each time data for three lines are output. In other words, when the first gate line, the third gate line, and the fifth gate line are sequentially turned on, the polarity of the common voltage Vcom is positive, and when the second gate line, the fourth gate line, and the sixth gate line are sequentially turned on, the polarity of the common voltage Vcom is negative. The same method is applied to the subsequent gate lines. When a next frame is displayed, a common voltage having opposite polarity to that of a previous frame is applied to the next frame, thereby preventing deterioration of the LCD.

Therefore, when the gate line shift circuit 1100 of FIG. 11 according to an embodiment of the present invention is used, the LCD panel including the gate drivers can scan the gate lines using the interleaving method.

In FIGS. 11 and 12, the same common voltage Vcom is applied to units of three gate lines at intervals of two lines (that is, to units of three gate lines with 1 gate line between each pair of adjacent gate lines in each unit). However, when the common voltage Vcom of the same polarity is applied to the gate lines in units of n lines at intervals of k lines, the gate line shift circuit of the LCD panel is designed to scan the gate lines in an interleaving order, i.e., in units of n lines at intervals of k lines.

In this case, a source driver of the LCD panel rearranges a scanning order and transmits source data in the rearranged order as in the embodiment in which gate drivers are additionally installed.

As described above, an LCD according to the present invention inverts the polarity of a common voltage every N lines instead of every line, thereby reducing power consumption. In addition, a very small-size memory is included in the LCD and data for N×k gate lines is latched in the memory. Then, the data is scanned for every $k^{th}$ line using an interlacing method. Therefore, a flickering phenomenon, which is absent in a line inversion driving method, can be prevented and power consumption can be reduced. In other words, the deterioration of image quality can be prevented.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A liquid crystal display (LCD) panel having gate drivers, the LCD panel comprising:

a plurality of pixels formed at intersections of a plurality of gate lines and a plurality of data lines, respectively; and a gate line shift circuit setting a gate line scanning order such that the gate lines are sequentially scanned in units of n gate lines with k−1 gate lines between each pair of adjacent gate lines in each unit according to an interleaving method, in response to a gate line-on signal received from a timing control unit outside the LCD panel, wherein the LCD panel reproduces source data output from a source driver outside the LCD panel in the gate line scanning order set by the gate line shift circuit;

wherein the LCD panel inverts the polarity of a gate electrode each time the LCD panel finishes scanning one unit of n gate lines;

wherein n=3 and k=2, the gate line shift circuit repeats sequentially scanning three 2k-th (k denotes a constant) gate lines after sequentially scanning three (2k+1)-th gate lines, and the LCD panel inverts the polarity of the gate electrode whenever three gate lines are scanned;

wherein the gate line shift circuit comprises a plurality of gate line switch blocks, each of the gate line switch blocks comprises six switches operating in synchronization with a clock signal and an inverted clock signal, each of the six switches is connected to a corresponding gate line, and a first switch in a first switch block is controlled by the gate line-on signal input from the timing control unit and a first switch in a next switch block is controlled by an output signal of a last switch in a previous switch block; and wherein each of the switch blocks comprises:

a first switch corresponding to a first gate line;

a second switch corresponding to a second gate line;

a third switch corresponding to a third gate line;

a fourth switch corresponding to a fourth gate line;

a fifth switch corresponding to a fifth gate line; and a sixth switch corresponding to a sixth gate line, wherein the first switch is turned on in response to the clock signal and the gate line-on signal or the output signal of the sixth switch in the previous block and turned off in response to an output signal of the third switch, the second switch is turned on in response to the inverted clock signal and an output signal of the fifth switch and turned off in response to an output signal of the fourth switch, the third switch is turned on in response to the inverted clock signal and an output signal of the first switch and turned off in response to the output signal of the fifth switch, the fourth switch is turned on in response to the clock signal and an output signal of the second switch and turned off in response to an output signal of the sixth switch, the fifth switch is turned on in response to the clock signal and the output signal of the third switch and turned off in response to the output signal of the second switch, and the sixth switch is turned on in response to the inverted clock signal and the output signal of the fourth switch and turned off in response to an output signal of the first switch in the next switch block.

2. The LCD panel of claim 1, wherein the gate line shift circuit sequentially scans the first gate line, the third gate line, the fifth gate line, the second gate line, the fourth gate line, and the sixth gate line connected to each of the switch blocks according to the interleaving method.

3. The LCD panel of claim 1, wherein the inverted clock signal is an inverted signal of the clock signal.

4. A gate line shift circuit designating a scanning order of gate lines included in an LCD panel having gate drivers and scanning non-contiguous blocks of the gate lines that are arranged in an overlapping block-wise fashion;

wherein the gate line shift circuit sets a gate line scanning order such that the gate lines are sequentially scanned in units of n gate lines at intervals of k gate lines according to an interleaving method, in response to a gate line-on signal received from a timing control unit outside the LCD panel;

wherein the gate line shift circuit scan a unit of n gate lines with k−1 gate lines between each pair of adjacent gate lines in the unit and then scans n gate lines adjacent to the previous n gate lines scanned at intervals of k gate lines after scanning the n gate lines, and the gate line shift circuit repeats this procedure for sequential blocks of k×n gate lines until the gate line shift circuit finishes scanning a frame;

wherein n=3 and k=2, the gate line shift circuit repeats sequentially scanning three 2k-th (k denotes a constant) gate lines after sequentially scanning three (2k+1)-th gate lines, and the LCD panel inverts the polarity of a gate electrode whenever three gate lines are scanned;

wherein the gate line shift circuit comprises a plurality of gate line switch blocks, each of the gate line switch blocks comprises six switches operating in synchronization with a clock signal and an inverted clock signal, each of the six switches is connected to a corresponding gate line, and a first switch in a first switch block is controlled by the gate line-on signal input from the timing control unit and a first switch in a next switch block is controlled by an output signal of a last switch in a previous switch block; and wherein each of the switch blocks comprises:

a first switch corresponding to a first gate line;

a second switch corresponding to a second gate line;

a third switch corresponding to a third gate line;

a fourth switch corresponding to a fourth gate line;

a fifth switch corresponding to a fifth gate line; and a sixth switch corresponding to a sixth gate line, wherein the first switch is turned on in response to the clock signal and the gate line-on signal or the output signal of the sixth switch in the previous block and turned off in response to an output signal of the third switch, the second switch is turned on in response to the inverted clock signal and an output signal of the fifth switch and turned off in response to an output signal of the fourth switch, the third switch is turned on in response to the inverted clock signal and an output signal of the first switch and turned off in response to the output signal of the fifth switch, the fourth switch is turned on in response to the clock signal and an output signal of the second switch and turned off in response to an output signal of the sixth switch, the fifth switch is turned on in response to the clock signal and the output signal of the third switch and turned off in response to the output signal of the second switch, and the sixth switch is turned on in response to the inverted clock signal and the output signal of the fourth switch and turned off in response to an output signal of the first switch in the next switch block.

5. The circuit of claim 4, wherein the gate line shift circuit sequentially scans the first gate line, the third gate line, the fifth gate line, the second gate line, the fourth gate line, and the sixth gate line connected to each of the switch blocks according to the interleaving method.

6. The circuit of claim 4 wherein the inverted clock signal is an inverted signal of the clock signal.

7. An LCD comprising:

a plurality of pixels formed at intersections of a plurality of gate lines and a plurality of data lines, respectively;

an LCD panel comprising a gate line shift circuit, which sets a gate line scanning order such that the gate lines are sequentially scanned in units of n gate lines with k−1 gate lines between each pair of adjacent gate lines in each unit according to an interleaving method in response to a gate line-on signal received from a timing control unit outside the LCD panel;

the timing control unit receiving image data from a graphics source, changing a scanning order of the image data to a new scanning order in which the image data is scanned in the units of n gate lines at intervals of k gate lines, generating a gate line-on signal for sequentially scanning the image data in the units of n gate lines at intervals of k gate lines outputting the gate line-on signal to the gate line shift circuit, and generating an inversion control signal transmitted to the gate line shift circuit every n gate lines;

a source driving unit selecting a gradation voltage to be applied to each of the pixels according to the image data output from the timing control unit and outputting the gradation voltage to the LCD panel; and a voltage generation unit generating and outputting the gradation voltage required by the source driving unit and inverting the polarity of a common voltage applied to each of the pixels, wherein the LCD panel reproduces source data output from the source driving unit in the gate line scanning order set by the gate line shift circuit;

wherein the gate line shift circuit comprises a plurality of gate line switch blocks, each of the gate line switch blocks comprises six switches operating in synchronization with a clock signal and an inverted clock signal, each of the six switches is connected to a corresponding gate line, and a first switch in a first switch block is controlled by the gate line-on signal input from the timing control unit and a first switch in a next switch block is controlled by an output signal of a last switch in a previous switch block, wherein each of the switch blocks comprises:

a first switch corresponding to a first gate line;

a second switch corresponding to a second gate line;

a third switch corresponding to a third gate line;

a fourth switch corresponding to a fourth gate line;

a fifth switch corresponding to a fifth gate line; and a sixth switch corresponding to a sixth gate line, wherein the first switch is turned on in response to the clock signal and the gate line-on signal or the output signal of the sixth switch in the previous block and turned off in response to an output signal of the third switch, the second switch is turned on in response to the inverted clock signal and an output signal of the fifth switch and turned off in response to an output signal of the fourth switch, the third switch is turned on in response to the inverted clock signal and an output signal of the first switch and turned off in response to the output signal of the fifth switch, the fourth switch is turned on in response to the clock signal and an output signal of the second switch and turned off in response to an output signal of the sixth switch, the fifth switch is turned on in response to the clock signal and the output signal of the third switch and turned off in response to the output signal of the second switch, and the sixth switch is turned on in response to the inverted clock signal and the output signal of the fourth switch and turned off in response to an output signal of the first switch in the next switch block.

8. The LCD of claim 7, further comprising an address changing unit repeatedly rearranging memory addresses in the units of n lines at intervals of k lines.

9. The LCD of claim 7, wherein n=3 and k=2, the gate line shift circuit repeats sequentially scanning three 2k-th (k denotes a constant) gate lines after sequentially scanning three (2k+1)-th gate lines, and the LCD panel inverts the polarity of the gate electrode whenever three gate lines are scanned.

10. The LCD of claim 7, wherein the polarity of the inversion control signal is inverted each time the scanning of one of the units of n gate lines is completed.

* * * * *